United States Patent [19]

Turpin

[11] 4,225,938

[45] Sep. 30, 1980

[54] TIME-INTEGRATING ACOUSTO-OPTICAL PROCESSORS

[75] Inventor: Terry M. Turpin, Columbia, Md.

[73] Assignee: The United States of America as represented by the Director of the National Security Agency, Washington, D.C.

[21] Appl. No.: 966,849

[22] Filed: Dec. 5, 1978

[51] Int. Cl.[3] ..... G06G 9/00; G06G 7/19

[52] U.S. Cl. ..... 364/822; 350/162 SF; 350/358; 364/837

[58] Field of Search ..... 364/819, 822, 713, 837; 350/162 SF, 358; 346/108

[56] References Cited

U.S. PATENT DOCUMENTS

| | | | |
|---|---|---|---|
| 3,509,453 | 4/1970 | Wilmotte | 364/822 X |
| 3,512,871 | 5/1970 | Zweig | 350/162 SF |
| 3,545,841 | 12/1970 | Dentino et al. | 350/358 |
| 3,634,749 | 1/1972 | Montgomery | 364/822 X |
| 3,641,355 | 2/1972 | Preston, Jr. | 364/822 X |
| 3,648,039 | 3/1972 | Kowalski | 364/822 |
| 3,661,441 | 5/1972 | Uchida et al. | 350/358 X |
| 3,746,427 | 7/1973 | Foster | 350/358 |
| 3,872,293 | 3/1975 | Green | 364/822 |
| 3,958,863 | 5/1976 | Isaacs et al. | 350/358 |
| 4,107,701 | 8/1978 | Sprague et al. | 346/108 |
| 4,110,016 | 8/1978 | Berg et al. | 350/358 |
| 4,123,142 | 10/1978 | Fleming et al. | 364/822 X |
| 4,158,503 | 6/1979 | Balasubramanian | 350/162 SF X |

OTHER PUBLICATIONS

Sprague et al., Time Integrating Acoustic Correlator Applied Optics, Jan. 1976, vol. 15, No. 1, pp. 89–92.

*Primary Examiner*—Felix D. Gruber

*Attorney, Agent, or Firm*—John R. Utermohle; Barry N. Young; Thomas O. Maser

[57] ABSTRACT

Disclosed are acousto-optical information processors employing a two-dimensional, time-integrating architecture. These three-product type processors are multipurpose processors which can perform a variety of complex signal processing operations in two-dimensions, without requiring two-dimensional spatial light modulators. Typical of these processing operations are two-dimensional correlation, spectrum analysis, and cross ambiquity function processing. Some of the two-dimensional processing operations are made possible by the incorporation into a two-dimensional correlator of a distributed local oscillator, which may be implemented with mechanical-optical or electro-optical techniques. The acousto-optical processors may be easily implemented with readily available optical and acousto-optical components.

16 Claims, 7 Drawing Figures

TIME-INTEGRATING ACOUSTO-OPTICAL PROCESSORS

BACKGROUND AND SUMMARY OF THE INVENTION

The present invention relates generally to the field of optical processors, and more particularly to the field of time-integrating optical processors for performing real-time correlations, transforms, and other processing operations.

There are a number of applications where it is desirable to process in real-time, information bearing signals. This is particularly true in the communications and radar processing fields. Normally, in these and similar fields, it is desirable to process in real-time, signals having fairly large information bandwidths. General purpose digital computers are capable of performing some of these processing operations. However, because of their limited speed, they are incapable of performing all but the very simplest of such processing operations in real-time. Special purpose digital signal processors, configured as array processors, typically can perform real-time processing operations if the information bandwidth of the signals is not too large. However, array processors are expensive, sophisticated, hardware devices which are difficult to program, and often the cost of such digital processing at very high data rates is prohibitive.

Because of their large time-bandwidth products and relative simplicity, optical processors represent an attractive alternative to processing large data rate signals. In the past, most optical processors have been of the space-integrating type. The basic principle involved in space-integrating processors is to place one signal into a light modulator so that the time window of the signal containing many cycles is simultaneously present in the optical system. This signal is then made to modulate a light beam to provide an optical signal which contains spatial variations related to the information signal. The resulting optical signal is then imaged with a lens system onto a second signal, which may be displayed in the form of transmission variations in an optical mask (transparency) to provide spatial filtering operations, or the second signal may be introduced as phase variations in the optical signal in a second light modulator. The light modulated by the two signals is then imaged with a second lens onto a single detector whose time-varying output represents the processed input signal. This second lens system integrates the total light signal in spatial dimensions, to provide a signal having intensity variations which is focused onto the single detector. Space-integrating optical processors suffer from the disadvantage that they are limited in time-bandwidth product to the time-bandwidth product of the optical components used in the processor.

Another type of optical processor employs a time-integrating architecture. Time-integrating optical processors basically differ from space-integrating processors in that instead of spatially integrating light onto a single detector, time-integrating devices perform a time integration of the light signal at each point in space. Accordingly, they overcome the limitation of the time-bandwidth product imposed by the optical components employed. Furthermore, they offer a greater flexibility than the space-integrating type of processor, and have less stringent construction tolerances.

A time-integrating correlator is the simplest processing operation to implement using the time-integrating architecture, and is the basic architecture from which other processing operations can be configured. Typical of devices of this type are the time-integrating correlators disclosed in U.S. Pat. No. 3,634,749 to Montgomery, and in Robert A. Sprague and Chris L. Koliopoulos, "Time Integrating Acousto-Optic Correlator," Applied Optics, Vol. 15, No. 1, January 1976. Both references disclose the use of acousto-optic devices as one-dimensional light modulators to provide one-dimensional time-integrating correlators. While these one-dimensional optical processors are useful for performing simple processing operations, there are many applications that require more sophisticated processing which is incapable of being performed using a one-dimensional processor architecture. For example, in the radar processing field, a radar signal is returned from a target shifted both in time and in frequency due to doppler phenomena. This requires ambiguity function processing, to be described more fully hereinafter, which can not be performed by a simple one-dimensional architecture. Such processing requires a two-dimensional architecture. Similarly, there are other processing operations which require a two-dimensional optical processing architecture.

Two-dimensional optical processors may be implemented by utilizing two-dimensional spatial light modulators, such as coherent light valves. Light valves, however, are relatively bulky and expensive devices to use in optical processing systems. Recent advances in optical processing technology, have resulted in significant improvements in acousto-optic devices, such as Bragg cells. These devices are small, compact, and relatively inexpensive. Furthermore, they provide relatively large bandwidths.

Accordingly, it is an object of the invention to provide new and improved two-dimensional optical processors which do not require two-dimensional spatial light modulators.

It is also an object of the invention to provide a time-integrating optical processor architecture.

It is a further object of the invention to provide optical processors capable of performing complex processing operations, such as three-product type processing.

It is a still further object of the invention to provide optical processors employing distributed local oscillators to perform certain processing operations.

It is additionally an object of the invention to provide optical processors employing electronic techniques to provide flexibility and dynamic processing capabilities.

It is also an object of the invention to provide optical processors capable of performing in real-time, processing operations on very high data rate signals.

A time-integrating optical processor having these and other advantages might include, a beam of light, means for modulating the light in first and second mutually orthogonal spatial dimensions using one-dimension spatial light modulators, and a two-dimensional time-integrating detector for detecting the modulated light beam and for providing an output signal representative of the processed information.

Description of Preferred Embodiments

Figure 1:
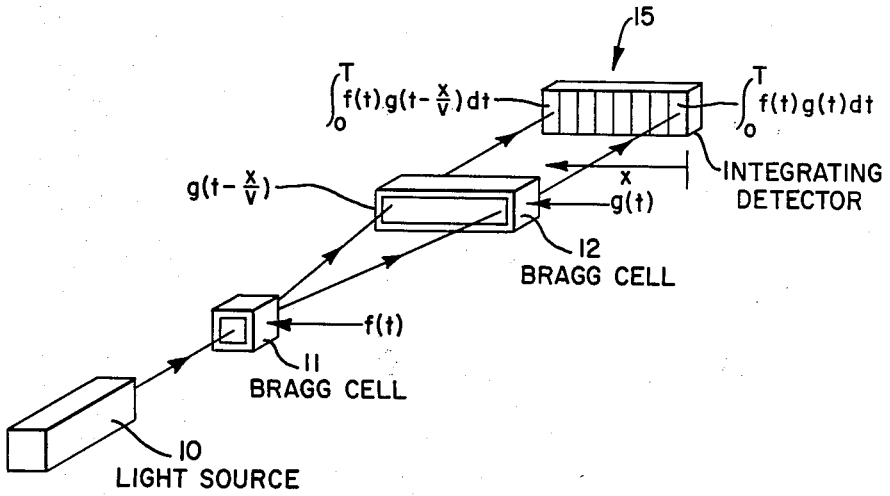
FIG. 1 is a generalized illustration of a one-dimensional time-integrating correlator.

FIG. 1 is an illustration of a one-dimensional time integrating correlator, drawn to illustrate the principles involved and not all of the optics required to implement it. A source of light 10 produces a light beam which is intensity modulated in an acousto-optical point modulator 11, which may be a Bragg cell, by a signal f(t). The diffracted light from Bragg cell 11 is then expanded in a horizontal dimension, by optics not illustrated, to illuminate a second acousto-optic modulator 12, which may also be a Bragg cell, fed by a second signal g(t). The light beam is intensity modulated in modulator 12 by $g(t-x/v)$, where x is the horizontal position along the Bragg cell and v is the velocity of sound in the cell. The doubly diffracted light from Bragg cell 12, expanded in the horizontal dimension, is imaged onto a linear detector array of photodiodes or CCD's, 15, which integrates the light intensity. The output of the detector at position x of the array is given by $$r(x) = \int_0^T f(t)g(t - \frac{x}{v})\,dt, \qquad (1)$$

which is the one-dimensional cross-correlation function of f(t) and g(t), where T is the detector integration time. With currently available detectors, the integration time can typically range from 100 microseconds to several seconds.

The correlator of FIG. 1 may be implemented either as a coherent or non-coherent optical system. Although non-coherent systems are somewhat simpler in terms of implementation, they have certain limitations not possessed by coherent systems. A disadvantage of non-coherent systems is that the input data and the input response of the optical system must be non-negative intensity distributions. There is no simple way in a non-coherent system to process bipolar inputs with bipolar inpulse responses. In the non-coherent correlator, the input signals f(t) and g(t) are placed as amplitude modulation on a carrier frequency centered in the passband of the Bragg cell, hence, the Bragg cell bandwidth must be twice the signal bandwidth, and the Bragg cells are operated in an intensity (square of light amplitude) modulation mode. In this mode, the intensity, rather than amplitude, of the modulated light is proportional to the driving voltage.

Bragg cells are currently available with bandwidths from 10 MHz to 1 GHz with corresponding delay times of 100 microseconds to 1 microsecond, respectively. If a 200 MHz bandwidth Bragg cell having a 10 microsecond delay time is used, and the detector integration time is 1 millisecond, then two 100 MHz signals can be correlated over a range of offsets from 0 to 10 microseconds, with a processing gain (integration time X bandwidth) of $10^5$. If 1000 detector elements are used in the linear detector, the array will produce an output rate of $10^6$ samples per second. This is a convenient rate for digital post-processing, which could be utilized to extend the integration time, and improve processing gain. This illustrates the processing gain and data rate reduction that are characteristic of the time-integrating architecture. The output of the correlator, equation (1), is the cross correlation of the two input signals f(t) and g(t).

If light source 10 is a laser, the correlator of FIG. 1 is a coherent time-integrating correlator. Here, the passband of interest in the input signals is upconverted to the passband of the Bragg cell with a single sideband modulator, on a carrier placed at one extreme of the passband of the Bragg cell. The light modulation is linear in amplitude rather than intensity, as is the case with the non-coherent system. Further, since the input to the Bragg cells is single sideband rather than double sideband amplitude modulation, the bandwidth of the system is increased by a factor of two. In addition, the drive requirements on the cells are reduced because Bragg cells are linear in amplitude at low diffraction efficiencies.

The coherent correlator requires a coherent reference beam at the detector, which is summed with the processing beam to detect points of correlation. The summing operation compares the phases of the reference and processing beams. Where the beams are in phase, the magnitudes add algebraically; where out of phase, they subtract. At a point where two signals are correlated, their relative phase difference remains constant, producing a constant magnitude which builds up for the integration time of the detector. When uncorrelated, their relative phase difference changes as a function of time and the amplitude integrates to some small (nominally zero) average value. Points of correlation then appear as deviations from this average. By proper selection of the reference beam, the output may be placed on a spatial carrier to extract the real and imaginary correlation components, simultaneously, thereby providing a true complex correlation processing operation.

There exists a certain class of processing operations which can not be performed by the one-dimensional processor of FIG. 1. Processing operations of the so called three-product type, exemplified by the generalized equation (15), infra, and explained in more detail hereinafter, can only be performed in a two-dimensional optical processor. As used herein, "two-dimensional" optical processors refers to processors of the three-product type which process signals in two or more dimensions. An optical processor is not a "two-dimensional" processor merely because it happens to use a two-dimensional detector. An example of two-dimensional processing operations includes ambiguity function (time-frequency correlation) processing, which is needed to correlate signals at unknown carrier frequencies. The problem arises in radar processing when a coded radar pulse is returned doppler shifted by a moving target. According to one aspect of the invention, a two-dimensional time-integrating processor capable of performing cross ambiguity function processing is illustrated in FIG. 2.

The cross ambiguity function is defined as $$x(\omega,\tau) = \int_O^T f(t)\, g(t-\tau) e^{j\omega t}\, dt, \tag{2}$$

where $\omega = 2\pi$ f and $\tau$ is a time delay. If f(t) and g(t) are doppler shifted replicas of each other, as would be the case where f(t) is a reference of the pulse transmitted by the radar and g(t) is the returned pulse, the term $e^{j\omega t}$ cancels the doppler shift at the correct frequency, $\omega$, resulting in the correlation function of the unshifted signals. At frequencies not equal to the doppler frequency, the integral of equation (2) is zero and no output is obtained. The doppler shift imposed on the return radar signal, and hence its frequency, is seldom known, although the range of expected doppler can typically be estimated. Therefore, the return signal must be multiplied by a plurality of frequencies within the expected range in order to determine which frequency zero beats with the returned signal to provide a correlator output. This essentially requires a distributed local oscillator that oscillates at all frequencies within the expected range and which may simultaneously be applied to the return signal by the processor.

Figure 2:
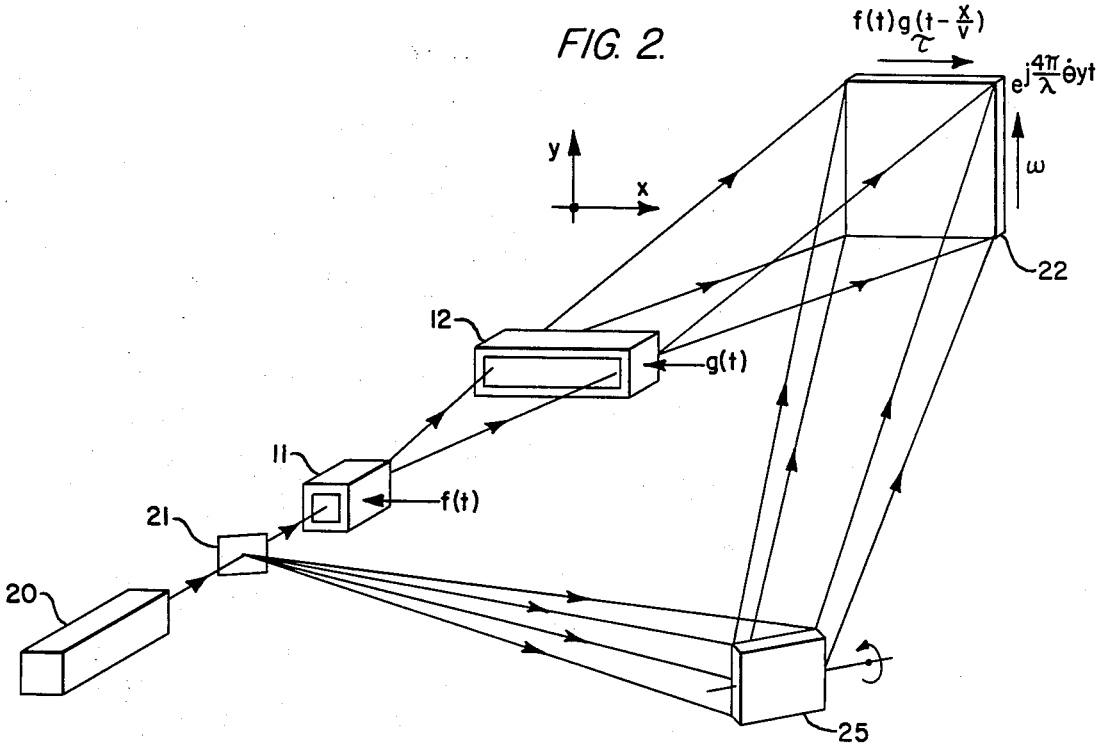
FIG. 2 is a generalized illustration of a two-dimensional time-integrating ambiguity processor, employing a moving mirror distributed local oscillator.

FIG. 2 is a generalized illustration of a coherent, two-dimensional, time-integrating optical processor. FIG. 2 is drawn to illustrate the concepts involved, not the optics. A laser, 20, provides a beam of coherent light, which is split into two beams, a processing beam and a reference beam, by beam splitter 21. The processing part of the beam from beam splitter 21 is provided to a one-dimensional spatial light modulator comprising acousto-optic Bragg cell light modulators 11, 12. Modulator 11 operates as a point modulator to modulate the processing beam with a signal f(t). The beam is expanded, by optics not illustrated, in the horizontal, x, dimension and applied to the second acousto-optic Bragg cell modulator 12, which modulates the beam with the second signal, g(t). The output from modulator 12 is then expanded in a vertical, y, direction by a lens system not illustrated, and imaged onto a two-dimensional integrating detector array 22. The light amplitude imaged on the detector has a variation of f(t) g(t−x/v) in the x, or horizontal dimension and is uniform in the vertical or y dimension. Light source 20 and light modulators 11 and 12 form a one-dimensional time-integrating correlator similar to that illustrated in FIG. 1. The light from modulator 12 however has been expanded in a vertical direction and imaged on a two-dimensional detector as opposed to the linear detector array of FIG. 1.

The reference portion of the coherent beam from laser 20 which is split off by beam splitter 21 is reflected by a mirror 25 and imaged onto the two-dimensional detector 22, where it is combined with the light from light modulator 12. If the mirror is stationary, it provides a plane wave $Ae^{\alpha x}$. The light amplitude on the detector is given by f(t) g(t−x/v)+$Ae^{\alpha x}$ and the corresponding intensity is $|f(t)\ g(t-x/v)|^2+A^2+2A\ f(t)\ g(t-x/v)\cos \alpha x$. If $\alpha$, the spatial carrier of the reference plane wave, is selected to be equal to or greater than the spatial bandwidth of the correlation function, the correlation term can be extracted with a high pass filter on the output of the detector. This is a coherent, one-dimensional, time-integrating correlator. However, if the signal g(t) is time-varying or a doppler shifted replica of f(t), the correlation output will be zero.

If the mirror 25 is permitted to rotate with a uniform angular velocity about a horizontal axis through its center, and the reflected light beam is imaged onto the detector plane 22, then for small linear motions of the mirror such that the tan x=x approximation is maintained, the light from the mirror will be linearly phase shifted in time (doppler shifted) by $e^{j4\pi\dot{\theta}yt/\lambda}$, where $\dot{\theta}$ is the angular velocity of the mirror, $\lambda$ is the wavelength, and y is the distance from the axis of the mirror. The moving mirror constitutes a one-dimensional spatial light modulator which modulates the reference beam in the vertical dimension.

The light amplitude on detector 22 is now $$f(t)\, g(t-\frac{x}{v}) + Ae^{j(\alpha x + \frac{4\pi}{\lambda}\dot{\theta} yt)}, \tag{3}$$

and the corresponding intensity is $$\left|f(t)\, g(t-\frac{x}{v})\right|^2 + A^2 + 2A\, f(t)\, g(t-\frac{x}{v}) \cos(\alpha x + \frac{4\pi}{\lambda}\dot{\theta}\, yt). \tag{4}$$

If the detector is allowed to integrate for a period of T, and only the term on the carrier is considered, then the output is $$X(x,y) = \int_O^T 2A\, f(t)\, g(t-\frac{x}{v}) \cos(\alpha x + \frac{4\pi}{\lambda} yt)\, dt. \tag{5}$$

This is a true complex cross ambiguity function on a spatial carrier $\alpha$. The processor is two-dimensional with the x axis of the display representing the relative time delay between f and g, and the y axis corresponding to the doppler frequency difference.

As an illustration let $f(t)=g(t)e^{j\Delta\omega t}$, where $\Delta\omega$ is the doppler frequency shift. The light intensity is $$g(t)\, g(t-\frac{x}{v})^2 + A^2 + 2A\, g(t)\, g(t-\frac{x}{v}) \cos[\alpha x + \frac{4\pi}{\lambda}\dot{\theta}\, yt - \Delta\omega\, t], \tag{6}$$

and the output from the detector is $$X(x,y) = 2A \int_O^T g(t-\frac{x}{v}) \cos(\alpha x + \frac{4\pi}{\lambda}\dot{\theta} yt - \Delta\omega\, t)\, dt. \tag{7}$$

The cosine term is stationary in time only if $(4\pi/\lambda)\theta y=\Delta\omega$. If $\Delta\omega$ and $(4\pi/\lambda)\theta y$ differ by one cycle over the period T, the cosine integrates to zero. At $(4\pi/\lambda)\theta y=\Delta\omega$ the output is the autocorrelation of g(t). The moving mirror produces a distributed local oscillator that oscillates at all possible frequencies over a given range as a function of y, and zero beats out any carrier difference in that range to produce an output from the detector. Carrier phase differences appear as a phase shift on the spatial carrier $\alpha$. The frequency resolution is the reciprocal of the detector integration time. Each scan of the detector 22 by the light beam reflected from mirror 25 represents a frame. After each frame, the mirror is reset to its original position to repeat its scan.

Figure 3:
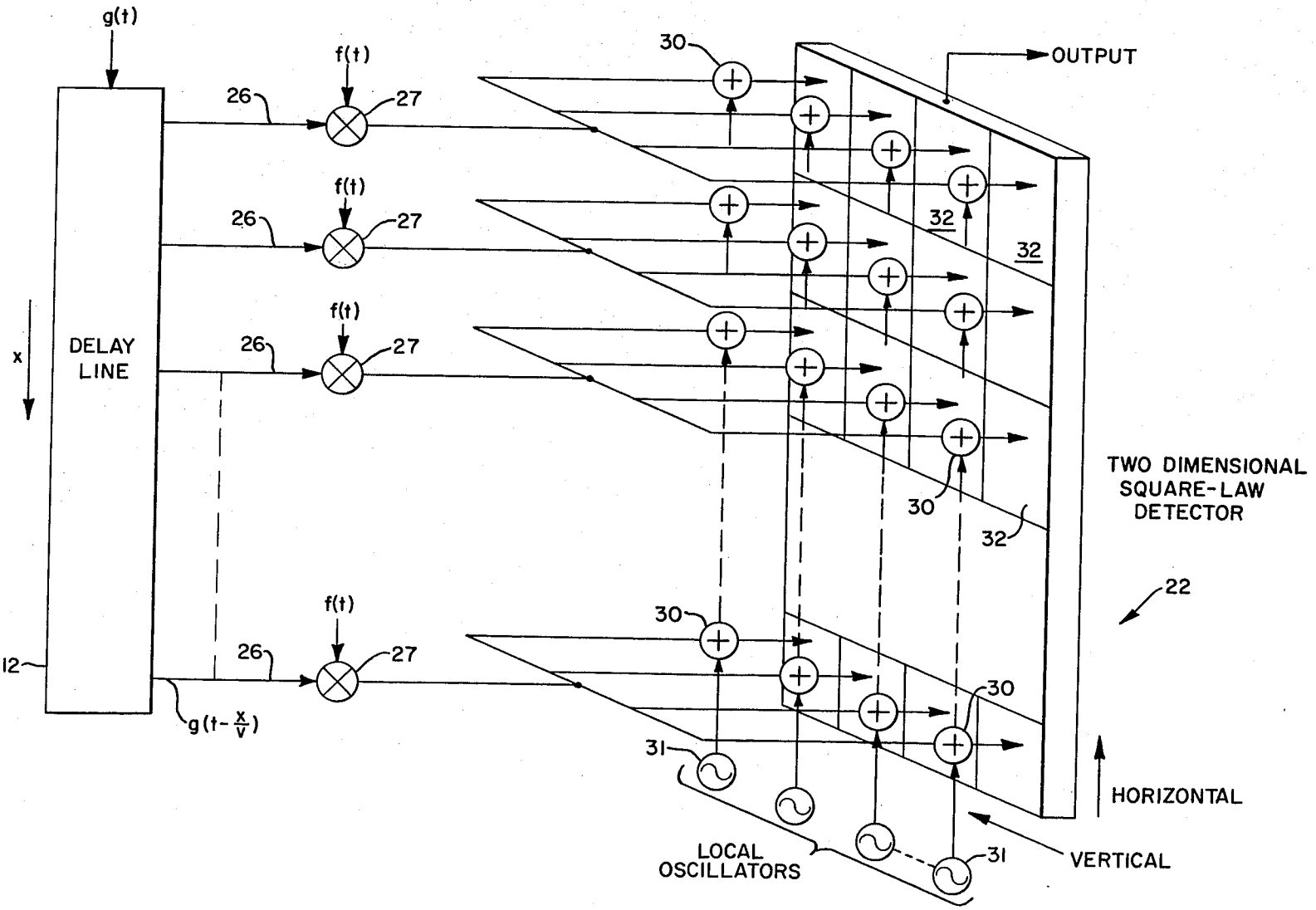
FIG. 3 is a model of the two-dimensional ambiguity function processor of FIG. 2, useful in explaining the operation of the processor.

A more complete understanding of the apparatus of FIG. 2 can be had by reference to FIG. 3, which illustrates an ambiguity processing model. As previously described, g(t), which may be a time delayed, doppler shifted replica of a transmitted radar signal, is input to a Bragg cell 12 which functions as a delay line. As g(t) propagates through the Bragg cell, it is delayed in time by an amount x/v, such that if taps 26—26 are placed at various points along the delay line, the output signal at each tap will be g(t−x/v). The output signal on taps 26—26, is then multiplied by the signal f(t) in a plurality of multipliers 27—27 to produce an output signal which is the product of f(t) and g(t) delayed by various times. To each of the output signals from multipliers 27—27, there is added in adders 30—30 a plurality of reference waves generated by local oscillators 31—31. The composite signals are then imaged onto the two-dimensional detector 22. The detector receives f(t)g(t−x/v) plus a local oscillator and forms the product through the square law process. Detector 22 can be considered as a plurality of photocells 32—32 arranged in a two-dimensional array. Each detector cell 32—32 integrates the resulting composite light intensity incident upon it for a given period of time, T. The outputs of the detector cells 32—32 are then provided as a detector output.

Assume for purposes of illustration, that g(t) is a return radar wave with a zero doppler shift, and that local oscillators 31—31 provide a reference plane wave of constant frequency. At the particular delay line tap 26 where the delay x/v is equal to the round-trip delay time of the radar signal, f(t) and g(t) will add in phase to produce a detector output. Each detector cell in the vertical column corresponding to the tap where the relative time delays are equal will provide an output, such that if detector 22 is a two-dimensional display, a vertical line will appear at a horizontal position which corresponds to the time delay x/v. Although the display is two-dimensional, the processor is only a one-dimensional correlator. If, however, g(t) is doppler shifted, the phases of g(t) and f(t) will not coincide and no output will be obtained. If local oscillators 31—31 are allowed to supply a plurality of different frequencies, at the point in the vertical dimension where the frequency of the local oscillator matches the doppler frequency on g(t), a zero beat will be obtained.

If the number of taps 26—26 on delay line 12 is allowed to approach infinity, a continuous delay between zero and $x_{max}/v$ can be obtained. This is the case with the Bragg cell modulator since the light is continuously delayed along the length of the cell. Similarly, if the number of local oscillators is allowed to approach infinity, a continuously distributed local oscillator is obtained. The moving mirror produces a light beam having continuously increasing frequency shift with distance from the axis of relative rotation of the mirror. This light beam is imaged on the detector and thus constitutes a continuously distributed local oscillator in the vertical dimension.

Figure 4:
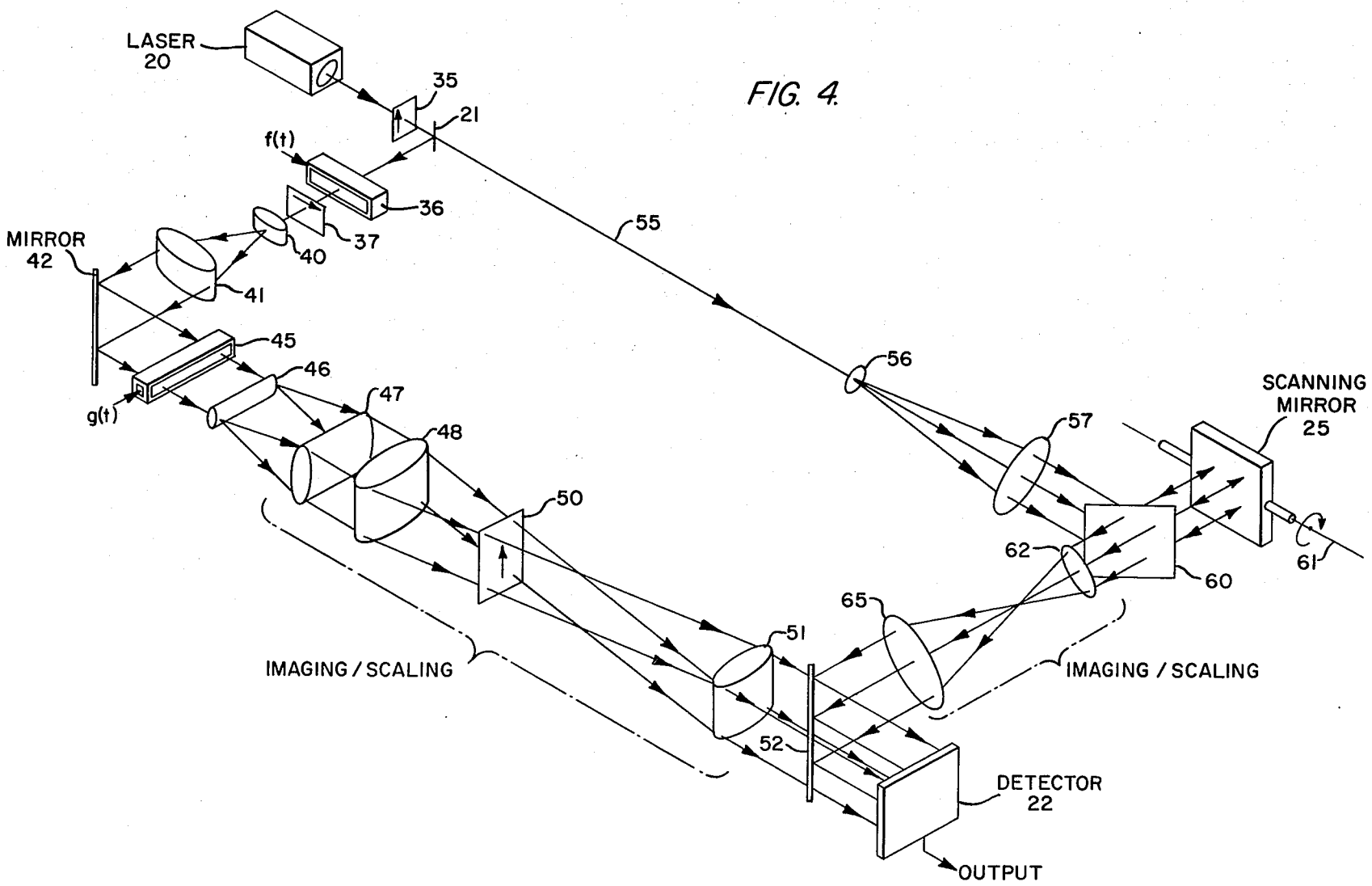
FIG. 4 is a detailed embodiment of the processor of FIG. 2.

FIG. 4 is a detailed embodiment of the optical processor of FIG. 2. Coherent light from laser 20 is first passed through a vertical polarizer 35 and split by beam splitter 21 into two optical beams. The processing beam is fed to a shear wave Bragg cell 36 which functions as a point modulator to modulate the amplitude of the coherent beam with the signal f(t). The light diffracted by Bragg cell 36 is rotated 90 degrees in polarization, and is passed through a horizontal polarizer 37 which blocks the undiffracted light. Cylindrical lens 40 spreads the light in a horizontal dimension where it is collimated by a second cylindrical lens 41 and passed to a stationary 45-degree mirror 42. The light reflected from mirror 42 is modulated in a second Bragg cell 45 by g(t). The diffracted light from Bragg cell 45 is expanded in a vertical dimension by cylindrical lens 46, and collimated and imaged by cylindrical lenses 47, 48 through a vertical polarizer 50 onto cylindrical lens 51. The light from cylindrical lens 51 is passed through a beam combiner 52 and imaged onto the two-dimensional detector array 22, which may be a vidicon, for example.

The second beam of light, 55, from beam splitter 21 is focused by lens 56 and 57 onto beam splitter 60. Light is reflected by beam splitter 60 onto the scanning mirror 25, which rotates about a horizontal axis 61. The light is reflected by scanning mirror 25 through beam combiner 60 where it is imaged by lenses 62 and 65 onto beam combiner 52. Beam combiner 52 reflects this light onto detector 22 where it is combined with the light beam modulated by f(t) and g(t). Detector 22 integrates the light intensity impinging on it and provides an output which, as previously described, represents the ambiguity function. This output may be further processed, if desired, to provide longer integration time and, consequently, improved resolution.

It should be noted that the optical processor requires only imaging and not transforming lenses. Hence, optical tolerances may be less rigid, since uniformity of response is not required, and the light source need be spatially coherent over only one resolution spot.

The optical components illustrated in FIG. 4 are all standard, readily available optical components. Scanning mirror 25 may be implemented in a number of available ways. For example, it may be implemented similar to the mirror in a galvanometer, where the rotation is controlled by the electromagnetic field produced by a circuit flowing in a coil. The scanning of scanning mirror 25 is adjusted to produce the desired frequency shift across the detector. As previously mentioned, the rotation of the mirror is controlled such that the the tan x=x approximation is maintained. Each scan of the mirror represents a complete frame of information.

Figure 5:
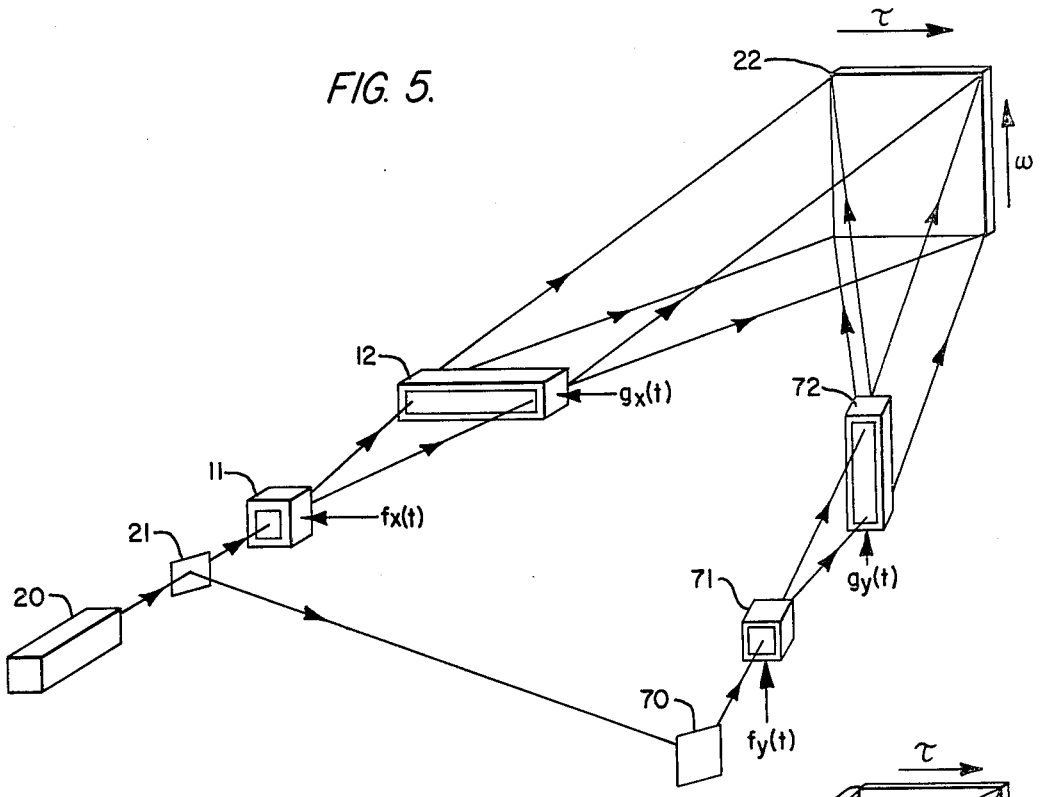
FIG. 5 is a generalized illustration of a two-dimensional time-integrating three-product type processor.

Distributed local oscillators can be produced by moving mirrors or any component that produces a dynamically tilted wave front. For example, the transform of a moving point source is a distributed local oscillator. Hence, distributed local oscillators may be implemented electronically to avoid the necessity for moving parts, such as the scanning mirror utilized by the apparatus of FIGS. 2 and 4. FIG. 5 illustrates an alternative processor to the processor illustrated in FIG. 2, that does not use a moving mirror to produce the distributed local oscillator. As will become apparent in the description, the processor of FIG. 5 has certain advantages over the processor of FIG. 2, including the fact that it has greater flexibility to perform a larger variety of operations, without the necessity for changing the optics.

Referring to FIG. 5, the moving mirror, 25, of FIG. 2 is replaced by a stationary mirror 70, and acousto-optical Bragg cell modulators 71 and 72 are added. The light reflected by mirror 70 is modulated in light modulators 71 and 72 by $f_y(t)$ and $g_y(t)$, the purpose of which will be explained more fully hereinafter.

Considering first the correlator portion of the optical processor of FIG. 2; assume that the moving mirror 25 is stationary. Assume further, that f(t) and g(t) are both chirps, i.e., signals having a frequency which is linearly increasing with time. That is, $$f(t) = g(t) = \cos(\omega_0 t + \frac{a}{2} t^2), \quad (8)$$

where $\omega_0$ and a are, respectively, the carrier frequency and angular acceleration of the chirp signal. The positive order diffraction from one light modulator is $$e^{j(\omega_0 t + \frac{a}{2} t^2)}, \quad (9)$$

and the negative order diffraction from the second light modulator is $$e^{-j[\omega_0(t - \frac{x}{v}) + \frac{a}{2}[t - \frac{x}{v}]^2]} \quad (10)$$

Hence, the doubly diffracted light is $$e^{j[\omega_0 t + \frac{a}{2} t^2 - \omega_0 t + \omega_0 \frac{x}{v} - \frac{a}{2} t^2 + \frac{atx}{v} - \frac{a}{2}(\frac{x}{v})^2]} = e^{j(\frac{atx}{v})} e^{+j[\frac{\omega_0 x}{v} - \frac{a}{2}(\frac{x}{v})^2]}. \quad (11)$$

This is a distributed local oscillator with a phase distortion in space. This phase distortion is unimportant if only relative phase measurements are required, and in any case it can be removed after detection as a fixed pattern. Thus, a distributed local oscillator has been produced as an electronic modulation on a light beam. This leads to the processor in FIG. 5.

Referring to FIG. 5, the light amplitude in the output plane at detector 22 is $$f_x(t)\, g_x(t - \frac{x}{v}) + f_y(t)\, g_y(t - \frac{y}{v})\, e^{j\alpha x}. \quad (12)$$

Figure 6:
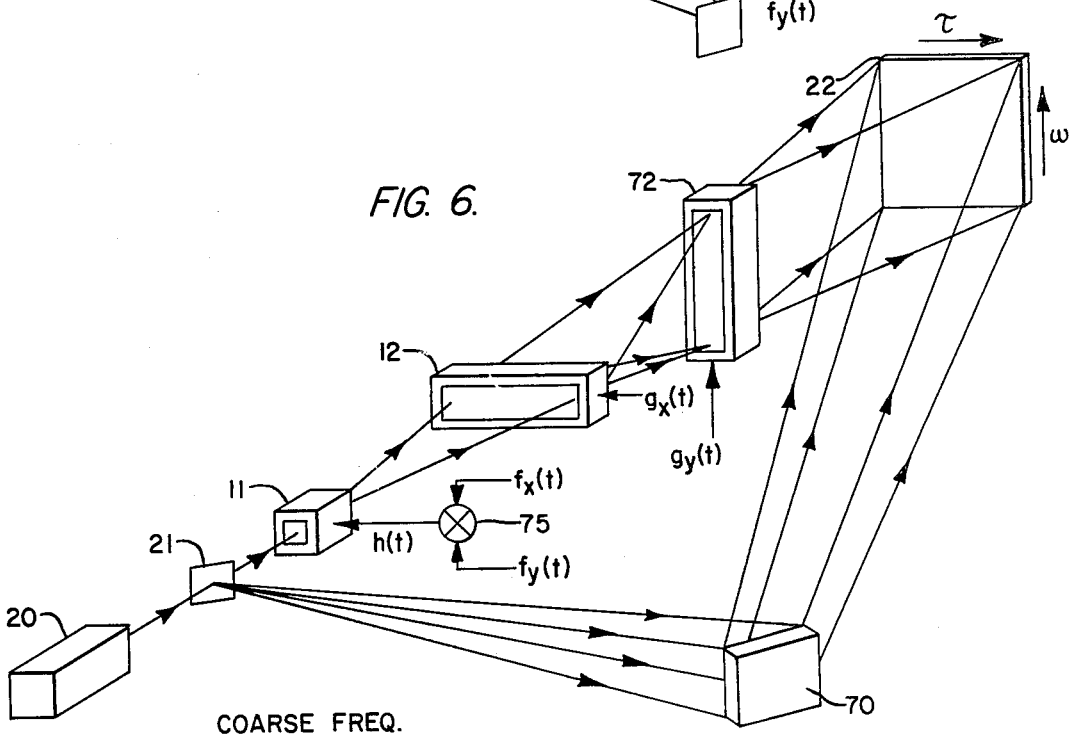
FIG. 6 is a generalized illustration of an alternative embodiment of a two-dimensional time-integrating three-product processor.

After integration and high pass filtering, it can be shown that the detector output is $$R(x,y) = 2A \int_0^T f_x(t)\, f_y(t)\, g_x(t - \frac{x}{v})\, g_y(t - \frac{y}{v})\, dt\, (\cos \alpha_x), \quad (13)$$

which is a two-dimensional correlation function on a spatial carrier $\alpha$. Thus, the processor of FIG. 5 is a two-dimensional time-integrating correlator, and a large class of operations are possible using this basic processor architecture. Note that since the signals $f_x(t)$ and $f_y(t)$ are introduced into point modulators, i.e., Bragg cells 11 and 71, they may be combined into a single function and light modulator $h(t)=f_x(t)\, f_y(t)$, as illustrated in FIG. 6. If $f_y(t)$ and $g_y(t)$ are chirps, i.e., $$c(t) = e^{j(\omega_0 t + \frac{a}{2} t^2)}, \quad (14)$$

the two-dimensional correlator of FIG. 5 becomes a cross ambiguity function processor.

The processor of FIG. 6 is an alternative embodiment of the processor of FIG. 5. By combining $f_x(t)$ and $f_y(t)$ in an electronic modulator 75 (substituting an electronic multiplication for an optical multiplication), and using the resulting function h(t) as a single input to Bragg cell 11, Bragg cell 71 can be eliminated. Furthermore, the processor can be physically configured as illustrated in FIG. 6 such that Bragg cell 72 is used to directly modulate the light from Bragg cell 12. Thus, the processors illustrated in FIGS. 5 and 6 are so-called three-product processors, which can be used to provide processing operations of the form $$A(x,y) = \int_0^T h(t)\, g_x(t - \frac{x}{v})\, g_y(t - \frac{y}{v})\, dt. \quad (15)$$

By proper selection of the functions h(t), $g_x(t)$ and $g_y(t)$, a large variety of processing operations can be performed. Furthermore, since h(t), $g_x(t)$ and $g_y(t)$ may be generated electronically, and optical multipliers interchanged with electronic multipliers, the processors of FIGS. 5 and 6 are very flexible and can be used for dynamic processing, as where it is desired to perform different types of processing as a function of time.

The two-dimensional correlators of FIGS. 5 and 6 can be used to implement a two-dimensional spectrum analyzer. The processor will take the Fourier transform of a time-varying input signal to provide a coarse frequency vs fine frequency output. Such an analyzer can provide a large array of filter elements (typically $10^5$ to $10^6$) over wide bandwidths. The advantage of the time-integrating architecture in this case is that the resolution and bandwidth can be scaled electronically. In addition, the two-dimensional correlators of FIGS. 5 and 6, or the moving mirror processor of FIG. 2, can be used to provide either a two-dimensional transform or ambiguity processor without modification to the optics.

Consider the time-integrating correlator used to implement the Fourier transform by the chirp algorithm. Let $$f(t) = S(t)\, e^{j[\omega_0 t + \frac{a}{2} t^2]} \quad (16)$$

where

S(t)=signal to be transformed $\omega_0$=carrier frequency a=angular acceleration of the chirp, and $$g(t) = e^{-j(\omega_0 t + \frac{a}{2} t^2)}, \quad (17)$$

where g(t) is the same chirp used to modulate S(t). The change in sign of the exponential comes from using the negative first-order diffraction rather than the positive order. The output light amplitude at the detector, using a reference wave $Ae^{j\alpha x}$ is $$S(t)\, e^{j(\omega_0 t + \frac{a}{2} t^2)}\, e^{-j[\omega_0(t - \frac{x}{v}) + \frac{a}{2}(t - \frac{x}{v})^2]} + Ae^{j\alpha x}. \quad (18)$$

The corresponding intensity is $$|S(t)|^2 + A^2 + 2S(t) \cos(\omega_0 \frac{x}{v} - \alpha x + \frac{atx}{v} - (\frac{x}{v})^2 \frac{a}{2}). \quad (19)$$

The detector integrates this intensity and produces an output proportional to $$\int_0^T 2S(t) \cos(\frac{atx}{v} - \alpha x + \frac{\omega_0 x}{v} - (\frac{x}{v})^2 \frac{a}{2})\, dt. \quad (20)$$

This is the Fourier transform of S(t). The transform is on a spatial carrier ($\omega_0/v$) and has a phase distortion $(x/v)^2a/2$. Such phase distortion is characteristic of the chirp transform. This one-dimensional spectrum analyzer can be considered as the product of S(t) and a set of oscillators running at frequency ax/v. Each product is then integrated on the detector.

If the chirps are repeated with a period T, then only local oscillators of frequency n/T (n=0,1,2 . . . ) exist. If the detector integrates for a period KT, then any frequency that deviates from a multiple of 1/T by more than 1/KT Hz will not produce a significant output. That is, the difference frequency will oscillate more than one cycle over the integration period KT. This means the output is a comb filter with passbands of width 1/KT and spaced 1/T apart. The spaces between the teeth of the comb can be filled in, as in the ambiguity processor, by a second distributed local oscillator covering the band from 0 to 1/T in frequency and orthogonal in space to the first. This leads to the two-dimensional spectrum analyzer.

Any of the three-product processors of FIGS. 2, 5 or 6 can be used to implement the two-dimensional spectrum analyzer, by providing the processor with the appropriate inputs. For example, using the processor of FIG. 5, let $f_x(t)$ and $g_x(t)$ be given by equations (16) and (17) respectively. Further, let $f_y(t)=g_y(t)$ be a slower chirp, $$c_2(t) = e^{j(\omega 2t + \frac{a2}{2} t2)}, \tag{21}$$

having a period equal to KT, the integration time. As previously described, this produces a distributed local oscillator in the orthogonal, vertical, dimension, which covers the band 0 to 1/T in frequency.

The output of the spectrum analyzer for the input signal S(t) will be in a raster format, with the fine frequency axis in the y dimension, along discrete coarse frequency lines spaced in the x dimension. Each point (x, y) on a line contains the spectral component at frequency $1/v(ax+a_2y)$. The fine frequency resolution is 1/KT with a range of $a_2T'/2$ Hz, where T' is the time aperture or delay of the acousto-optic modulators. The separation between coarse frequency lines is 1/T. In order that the spectrum be presented without "holes" or redundancy, the fine frequency range should equal the coarse line separation. Similarly, the coarse frequency range is a $T'/2\pi$Hz.

$$KT>>T,\ B\geqq aT/2\pi,\ \text{and}\ B\geqq a_2KT/2\pi,$$

where B is the bandwidth of the acousto-optic modulators. Practically, the number of resolution elements is limited by the number of detector cells.

Figure 7:
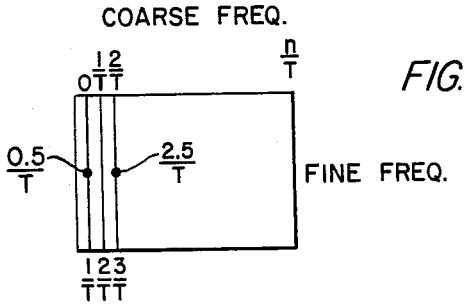
FIG. 7 is an illustration of a two-dimensional spectrum analyzer output.

To illustrate the spectrum analyzer, assume an input frequency of 1.5/T. This will beat with the horizontal local oscillator running at 1/T to produce a difference of 0.5/T. This difference will then mix with the 0.5/T vertical local oscillator to produce a DC output that will build up on the integrator. The output format is shown in FIG. 7. Both axes now represent frequency. A change in frequency of 1/T causes the output to step one element in the horizontal dimension. A change in frequency equal to the reciprocal of the detector integration time causes the output to step one resolution element in the vertical dimension.

It should be emphasized that the optical architecture of the two-dimensional spectrum analyzer is identical to the ambiguity function processor, only the electronic nature of the signals need be changed to alter the cross ambiguity processor to the two-dimensional spectrum analyzer. Similarly, by supplying appropriate inputs, the two-dimensional optical processors can perform a variety of processing operations. It should also be obvious to those skilled in the art that, in most cases, it makes little difference into which modulators the various signals are input, or whether the multiplications take place electronically in mixers or in the detector, or optically in the light modulators.

In addition, while the differences in optical architecture between the processors of FIGS. 2, 5 and 6 may offer some economies in terms of components, in general, the processing capabilities of the different architectures are the same. As previously explained, the processors of FIGS. 5 and 6 are basically the same. The processor of FIG. 6 simply substitutes an electronic multiplication for an optical multiplication, and performs all optical multiplications "in line" on the same optical beam. Light modulator 72, could equally as well have been left in the same position as illustrated in FIG. 5, while still combining $f_x(t)$ and $f_y(t)$ in modulator 75 to eliminate light modulator 71. Similarly, the moving mirror of the processor of FIG. 2 could equally as well have been used to impose a linearly varying frequency shift on the modulated light beam from light modulator 12 directly, by repositioning it to receive the diffracted light from modulator 12, and repositioning the detector to receive the reflected light from the mirror. However, since it would have still been necessary to provide a reference beam to the detector, a stationary mirror would also have been required. Accordingly, the architecture of FIG. 2 is a bit more efficient in its use of optical components. The processing capabilities of the two architectures are the same, however.

While the foregoing has been with reference to specific embodiments, it will be appreciated by those skilled in the art that numerous variations are possible without departing from the invention. It is intended that the invention be limited only by the appended claims.

What is claimed is:

1. A time-integrating optical processor comprising:

a light beam;

a two-dimensional time-integrating detector;

means for modulating the light beam in a first spatial dimension, x, said x-modulating means including a first one-dimensional spatial light modulator;

means for expanding the x-modulated beam in a second, mutually orthogonal spatial dimension, y;

means for modulating the light beam in the second spatial dimension, said y-modulating means including a second one-dimensional spatial light modulator; and means for imaging said expanded x-modulated and said y-modulated light beams onto the detector.

2. The optical processor of claim 1 wherein said first spatial light modulator comprises:

a first acousto-optic light modulator for modulating said light beam with a first signal $f_x(t)$; and a second acousto-optic light modulator for modulating the light beam from said first acousto-optic modulator with $g_x(t-x/v)$, where v is the velocity of sound propagation in said second acousto-optic modulator in said first spatial dimension, x, and $g_x(t)$ is a second signal input to said second acoustic-optic modulator, thereby providing a light beam having an amplitude variation of $f_x(t)$ $g_x(t-x/v)$ in said x dimension.

3. The optical processor of claim 2, wherein said second spatial light modulator comprises means for modulating said light beam in said second spatial dimension, y, with a continuously distributed local oscillator signal.

4. The optical processor of claim 3, wherein said second spatial light modulator is a scanning mirror having small linear rotations about an axis parallel to said first spatial dimension, x, such that said light beam is reflected from said mirror with a linearly varying frequency shift in said y dimension.

5. The optical processor of claim 2 wherein said second spatial light modulator comprises a third acousto-optic light modulator for modulating said light beam in said second spatial dimension, y, with $g_y(t-y/v)$, where v is the velocity of sound propagation in said third acousto-optic modulator in said second spatial dimension, y, and $g_y(t)$ is a third signal input to said third acousto-optic modulator.

6. The opticl processor of claim 5 wherein said second spatial light modulator further comprises a fourth acousto-optic light modulator for modulating said light beam with a fourth signal, $f_y(t)$, thereby providing a light beam having an amplitude variation of $f_y(t)$ $g_y(t-y/v)$ in said y dimension, said optical processor being a two-dimensional correlator.

7. The optical processor of claim 6 wherein said signals $f_y(t)$ and $g_y(t)$ are chirp signals, thereby providing a distributed local oscillator in said y dimension.

8. The optical processor of claims 4 or 6 wherein said means for modulating said light beam in mutually orthogonal spatial dimensions further comprises means for splitting said light beam into first and second light beams, said first and second light beams modulating by said first and second spatial light modulators, respectively, and wherein said optical processor further comprises means for imaging and combining said first and second light beams on said time-integrating detector.

9. The optical processor of claims 3 or 7 wherein said first signal, $f_x(t)$, is an information signal to be processed; said second signal, $g_x(t)$, is a predetermined reference signal and said processor is a two-dimensional ambiguity function processor.

10. The optical processor of claim 2 wherein said first signal $$f_x(t) = S(t)\, e^{j(\omega 0t + \frac{a}{2} t2)},$$

where S(t) is an information signal to be processed and $$e^{j(\omega 0t + \frac{a}{2} t2)}$$

is a chirp signal having a carrier frequency of $\omega_o$ and an angular acceleration of a; and said second signal $g_x(t)$ is a chirp signal, $$e^{-j(\omega 0t + \frac{a}{2} t2)}.$$

11. The optical processor of claim 10 further comprising:

means for repeating said chirps with a period of T seconds; and wherein said second spatial light modulator includes means for modulating said second beam of light in said spatial dimension y, with a distributed local oscillator having a continuous frequency distribution between 0 and 1/T, thereby providing a two-dimensional spectrum analyzer.

12. The optical processor of claim 1 wherein said first one-dimensional spatial light modulator comprises:

an electronic modulator for generating a first signal h(t) as the product between second and third signals, $f_x(t)$ and $f_y(t)$;

a first acousto-optic light modulator for modulating said light beam with said signal h(t);

a second acousto-optic light modulator for modulating said light beam with $g_x(t-x/v)$, where v is the velocity of sound propagation in said second acousto-optic light modulator in said first spatial dimension, x, and $g_x(t)$ is a fourth signal input to said second acousto-optic modulator; and wherein said second one-dimensional spatial light modulator comprises:

a third acousto-optic light modulator for modulating said light beam with $g_y(t-y/v)$, where v is the velocity of sound propagation in said third acousto-optic modulator in said second spatial dimension, y, and $g_y(t)$ is a fifth signal input to said third acousto-optic modulator, thereby providing a light beam having an amplitude variation of $h(t)g_x(t-x/v)g_y(t-y/v)$.

13. The optical processor of claim 12 wherein the type of processing performed by said optical processor is determined by the selection of said signals $f_x(t)$, $f_y(t)$, $g_x(t)$, and $g_y(t)$.

14. A time-integrating optical processor, comprising:

a light beam;

means for splitting said light beam into first and second light beams;

a first acousto-optic light modulator for modulating said first light beam with a first signal, f(t);

first spreading means for spreading the modulated light beam from said first acousto-optic modulator in a first spatial dimension, x;

a second one-dimensional acouto-optic light modulator for modulating said spread light beam from said first acousto-optic modulator in said first spatial dimension, x, with a second signal g(t);

second spreading means for spreading the diffracted light from said second acousto-optic modulator in a second spatial dimension, y, orthogonal to said first spatial dimension, x;

a scanning mirror having small linear rotations about an axis parallel to said x dimension for reflecting said second light beam from said mirror with a linearly varying frequency shift in said y dimension; and a two-dimensional time-integrating detector for detecting said light beams from said second spreading means and from said scanning mirror.

15. The optical processor of claim 14 wherein said signal g(t) is a time-delayed and frequency shifted replica of f(t) and said optical processor is an ambiguity function processor for detecting and providing an output signal representative of said time delay and frequency shift.

16. The optical processor of claims 2, 5, 6, 12 or 14, wherein said acousto-optic light modulators are Bragg cell modulators.

* * * * *